US011011860B1

(12) United States Patent
Wu

(10) Patent No.: US 11,011,860 B1
(45) Date of Patent: May 18, 2021

(54) PLUG TERMINAL BLOCK STRUCTURE

(71) Applicants: DINKLE ENTERPRISE CO., LTD., New Taipei (TW); DINKLE ELECTRIC MACHINERY (CHINA) CO., LTD., Jiangsu (CN)

(72) Inventor: Shang-Tsai Wu, New Taipei (TW)

(73) Assignees: DINKLE ENTERPRISE CO., LTD., New Taipei (TW); DINKLE ELECTRIC MACHINERY (CHINA) CO., LTD., Jiangsu (CN)

( * ) Notice: Subject to any disclaimer, the term of this patent is extended or adjusted under 35 U.S.C. 154(b) by 0 days.

(21) Appl. No.: 16/880,952

(22) Filed: May 21, 2020

(51) Int. Cl.
*H01R 9/24* (2006.01)
*H01R 4/48* (2006.01)

(52) U.S. Cl.
CPC ..... *H01R 9/2416* (2013.01); *H01R 4/48* (2013.01); *H01R 4/4836* (2013.01); *H01R 9/2491* (2013.01)

(58) Field of Classification Search
CPC .. H01R 4/4818; H01R 4/4827; H01R 4/4836; H01R 4/4845; H01R 9/2416
See application file for complete search history.

(56) References Cited

U.S. PATENT DOCUMENTS

2020/0243988 A1* 7/2020 Ono ..... H01R 4/4827

* cited by examiner

*Primary Examiner* — Ross N Gushi

(74) *Attorney, Agent, or Firm* — Chun-Ming Shih; HDLS IPR Services

(57) ABSTRACT

A plug terminal block structure for plugging a wire includes an insulated base, a conductive spring plate and a metal terminal. The insulated base has a cavity and a wire inlet for inserting and connecting the wire. The wire inlet has a wire arm and an embedded slot. A fixed portion is formed in the cavity. The conductive spring plate is installed in the cavity and has a clamping arm formed in the wire inlet. The metal terminal includes a riser, and a pin connected to the riser and embedded into the embedded slot and formed on a side of clamping arm. Both of the riser and wire arm are stopped at the conductive spring plate and a side of the wire. Therefore, the wire will not be exposed, and the conductive spring plate can be limited stably in the cavity to improve the safety of use.

11 Claims, 7 Drawing Sheets

PLUG TERMINAL BLOCK STRUCTURE

BACKGROUND OF THE INVENTION

1. Technical Field

The technical field of this disclosure relates to a terminal block, and more particularly to a plug terminal block structure.

2. Description of Related Art

Terminal block is a common connection assembly which has already been used widely in various different areas such as communication products, industrial equipment for integrating devices, power industry, industrial control, etc. The terminal block is not just capable of improving the reliability and safety of a power system only, but also allowing the industrial equipment to achieve a high degree of automation.

In general, a conventional plug terminal block structure comprises an insulated base, a conductive spring plate and a metal terminal, and the insulated base further comprises a wire inlet for inserting and connecting a wire, a conductive spring plate installed in the insulated base, and a metal terminal fixed to the insulated base and electrically coupled to the conductive spring plate.

However, in the conventional plug terminal block structure, after the wire is inserted into the wire inlet, the wire is tilted and exposed from insulated base and affects the safety of use. In addition, the tilted wire may also cause the conductive spring plate and the metal terminal to slide, so as to hinder the electrical connection between the wire and the metal terminal.

In view of the aforementioned drawbacks of the prior art, the discloser of this disclosure based on years of experience in the related industry to conduct extensive research and experiment, and finally provided a feasible solution to overcome the drawbacks of the prior art.

SUMMARY OF THE INVENTION

Therefore, it is a primary object of this disclosure to provide a plug terminal block structure, wherein after the wire is inserted and coupled into the wire inlet, the wire will not be exposed to the outside, and the conductive spring plate can be stably limited in the cavity to improve the safety of use.

To achieve the aforementioned and other objectives, this disclosure discloses a plug terminal block structure for plugging a wire comprises an insulated base, a conductive spring plate and a metal terminal, characterized in that the insulated base has a cavity and a wire inlet communicating with the cavity and provided for inserting and connecting the wire, and a wire arm is formed on a side of the wire inlet and an embedded slot is formed on the other side of the embedded slot, and a fixed portion is formed in the cavity. The conductive spring plate is installed in the cavity and corresponding to the fixed portion and has a clamping arm formed in the wire inlet. The metal terminal comprises a riser, and a pin connected to an end of the riser and embedded into the embedded slot and formed on a side of clamping arm. Both of the riser and the wire arm are stopped at the conductive spring plate and a side of the wire.

This disclosure has the following effects. The step block of the wire arm and the step slot of the riser provide a stable structure to effectively prevent the metal terminal from falling out from the insulated base. Each through hole formed at the curvedly connected position of the riser and the horizontal plate to facilitate bending and formation in the manufacturing process. The reinforcing rib installed to the riser enhances the structural strength, and each of engaging teeth improves the pin's retention of the wire. The latch abuts an end of the clamping arm to prevent an excessive deformation of the clamping arm. The metal terminal not just has a simple structure only, but also has the features of easy manufacturing and low cost.

DESCRIPTION OF THE PREFERRED EMBODIMENTS

Figure 1:
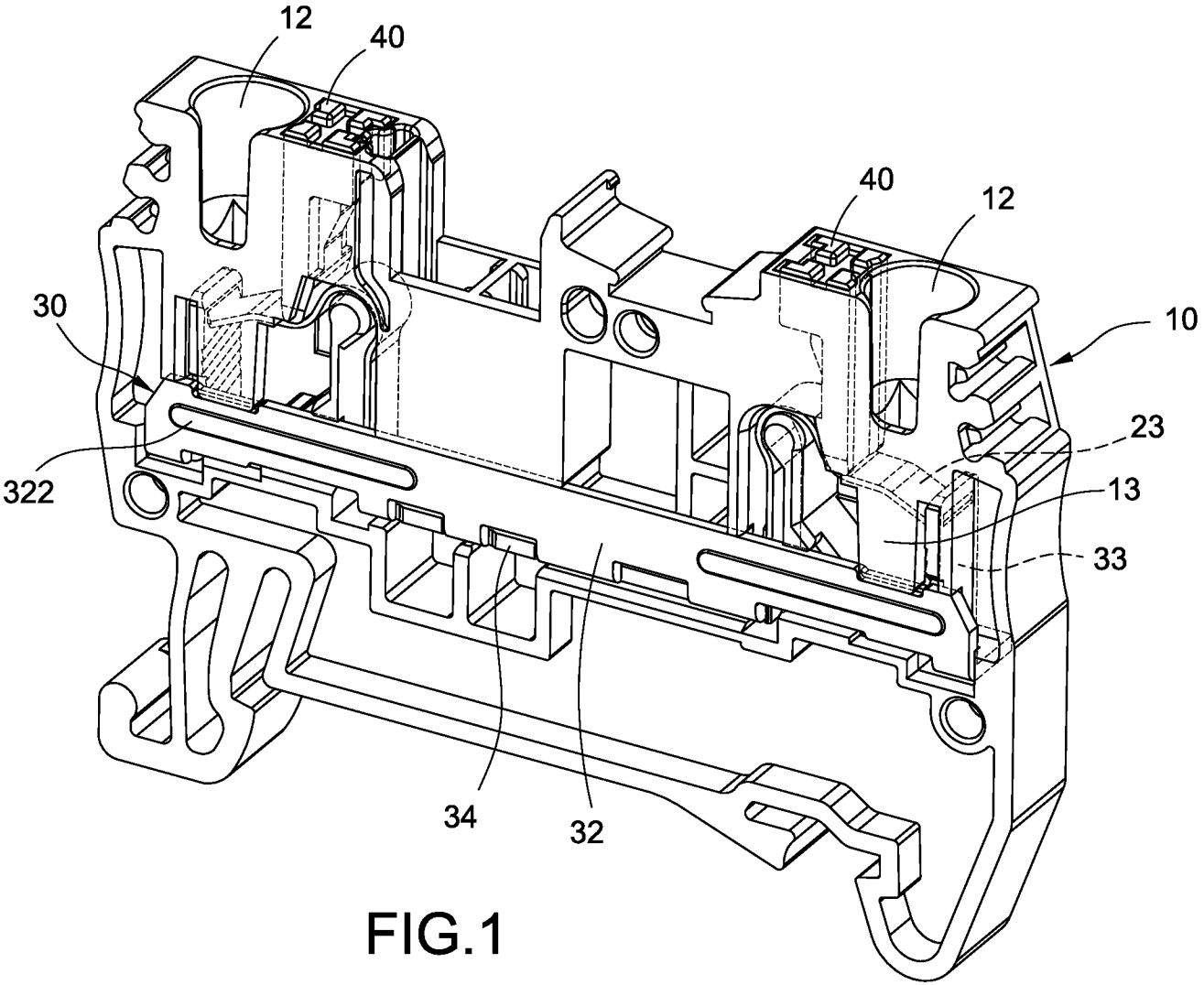
FIG. 1 is a perspective view of a plug terminal block structure of this disclosure.
Figure 2:
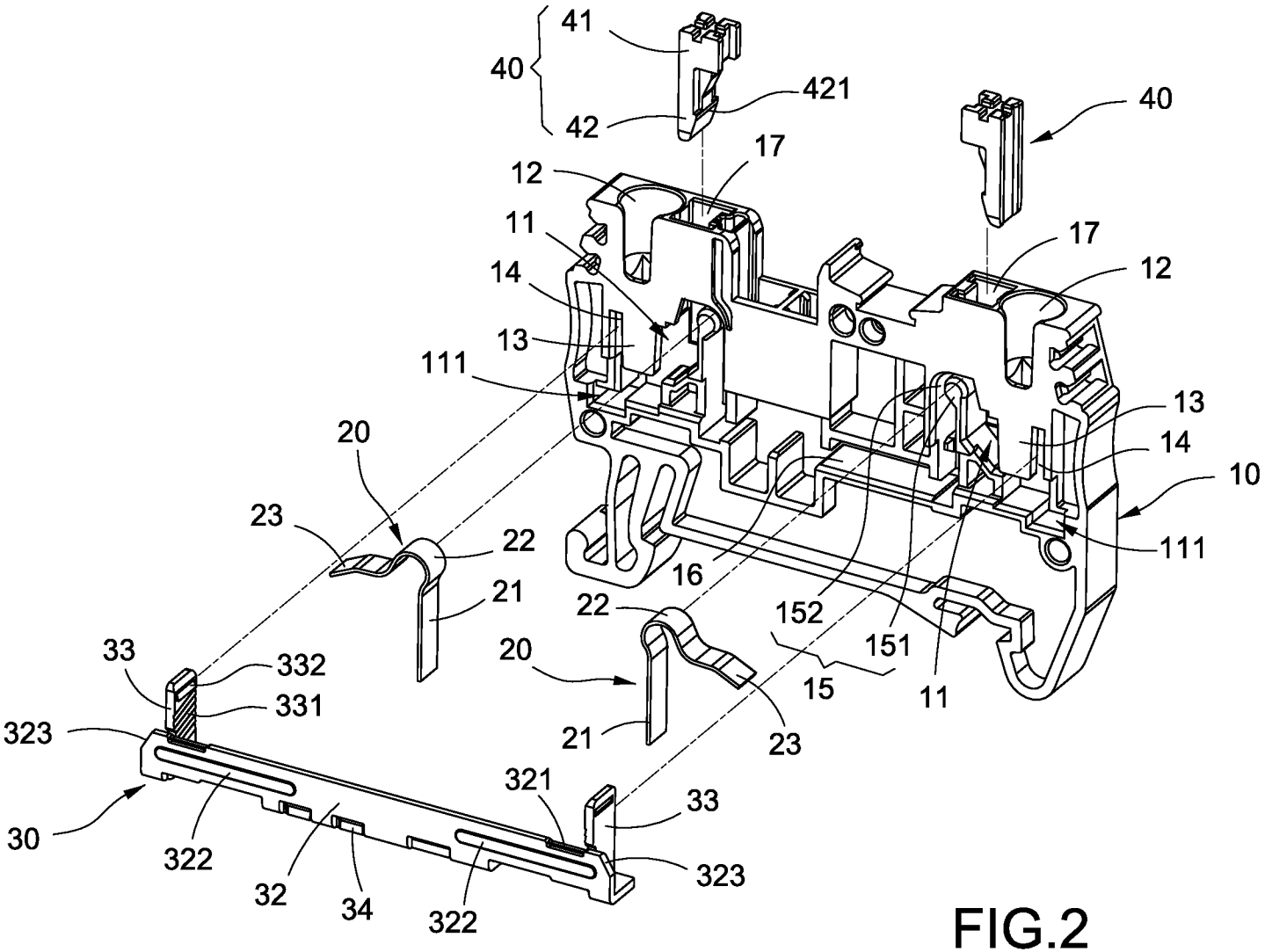
FIG. 2 is an exploded view of a plug terminal block structure of this disclosure.
Figure 3:
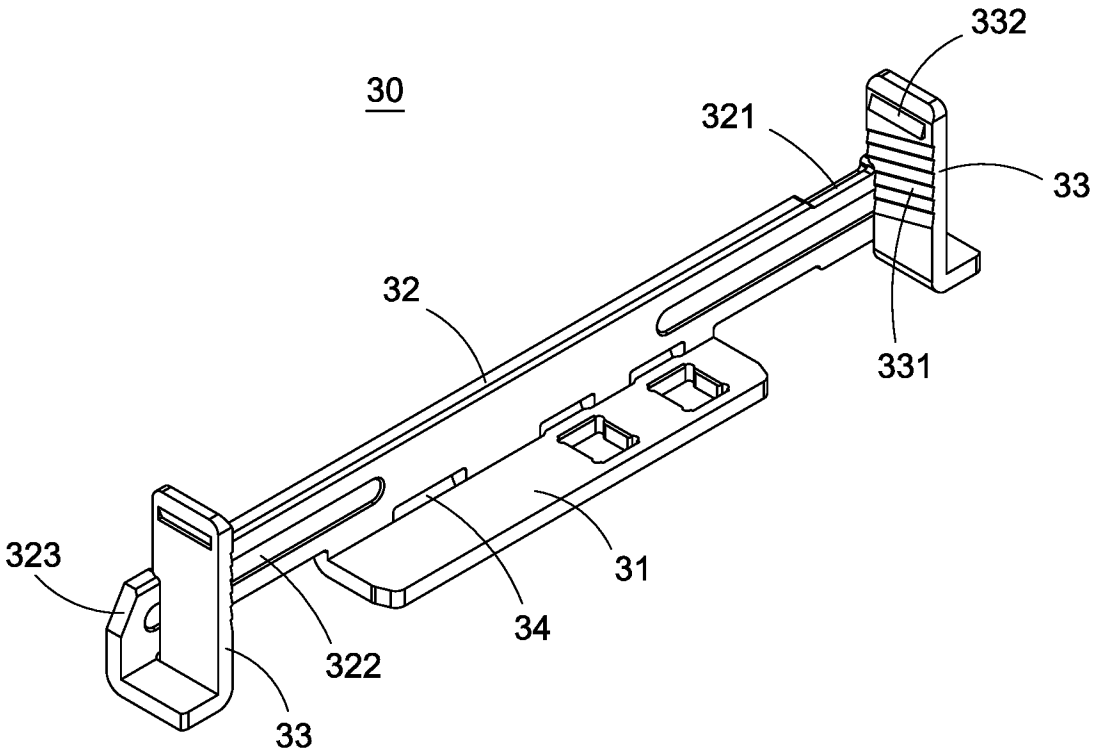
FIG. 3 is a perspective view of a metal terminal of this disclosure.
Figure 4:
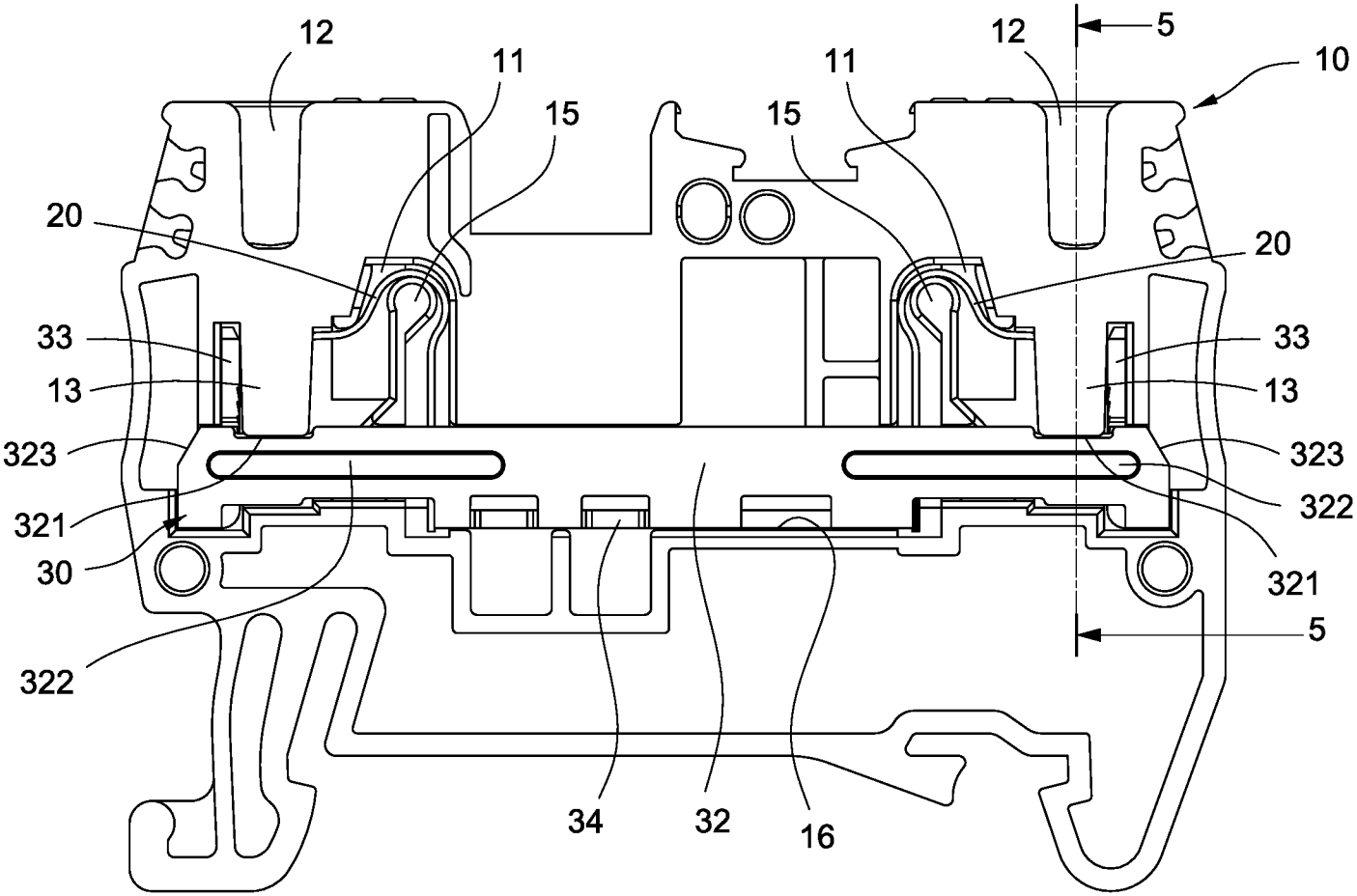
FIG. 4 is a front view of a plug terminal block structure of this disclosure.

The technical contents of this disclosure will become apparent with the detailed description of preferred embodiments accompanied with the illustration of related drawings as follows. It is intended that the embodiments and drawings disclosed herein are to be considered illustrative rather than restrictive.

With reference to FIGS. 1 to 6 for a plug terminal block structure of this disclosure, the plug terminal block structure comprises an insulated base 10, a conductive spring plate 20, and a metal terminal 30.

The insulated base 10 is made of a material with good insulation such as plastic, and substantially a flat body. In an embodiment of this disclosure, the insulated base 10 comprises two cavities 11 formed on the left and right sides of the insulated base 10 respectively, and each cavity 11 has a window 111, and a wire inlet 12 is formed at the top of the insulated base 10 and communicating with each cavity 11, and a wire arm 13 is formed on a side corresponding to each wire inlet 12, and this wire arm 13 is formed on a side of the window 111. In addition, an embedded slot 14 is formed on the other side of the lower half of the wire inlet 12, and this embedded slot 14 separates the wire arm 13 and the insulated base 10 from each other. In addition, a fixed portion 15 is formed inside each cavity 11 and away from the wire inlet 12. In this embodiment, the fixed portion 15 comprises a spring plate bracket 151 and a spring plate slot 152 formed between the outer periphery of the spring plate bracket 151 and the insulated base 10.

Further, a horizontal slot 16 is formed between two cavities 11 of the insulated base 10 and communicates with each cavity 11*a*, and a release member jack 17 is disposed at the insulated base 10 on a side of each wire inlet 12, and each release member jack 17 communicates with each respective cavity 11.

In addition to the insulated base 10 in accordance with the aforementioned embodiment of, there are a cavity 11, a wire inlet 12, a wire arm 13, an embedded slot 14, a fixed portion 15 and a release member jack 17 (with the quantity of one each, not shown in the figure).

The conductive spring plate 20 is made a material with good electrical conductivity such as copper or its alloy and installed in the cavity 11 and configured to be corresponsive to the fixed portion 15. In this embodiment, the conductive spring plate 20 comprises a fixed arm 21, an arcuate section 22 extending from the fixed arm 21, and a clamping arm 23 extending from the arcuate section 22, wherein the arcuate section 22 is embedded into the spring plate slot 152 and clamped between the spring plate bracket 151 and the insulated base 10, and the clamping arm 23 extends through the release member jack 17 and its end section is formed into the wire inlet 12, and the fixed arm 21 extends vertically downward and is formed at an end of the horizontal slot 16.

Figure 7:
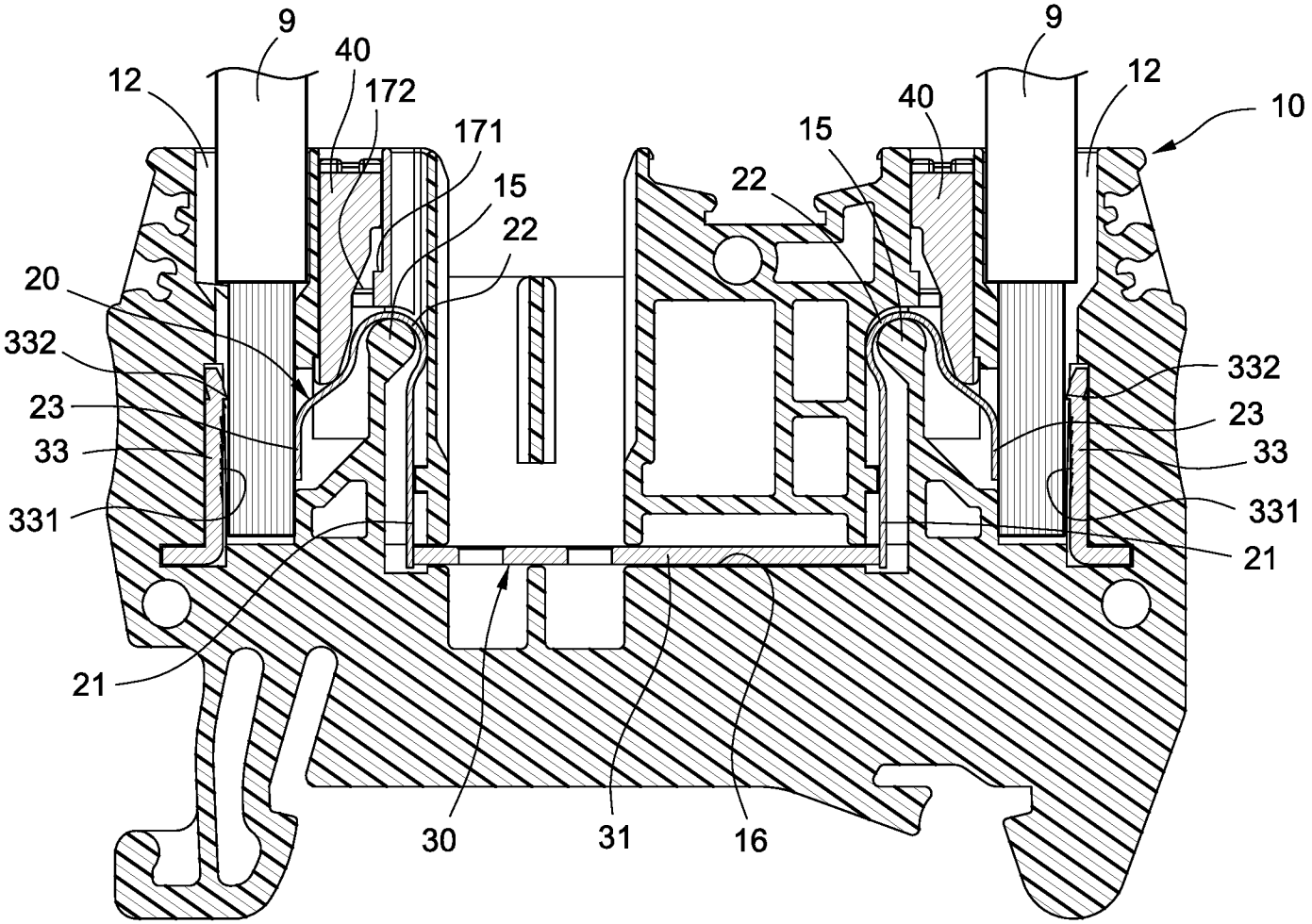
FIG. 7 is a cross-sectional view of a disclosure plug terminal block structure and a wire assembly in accordance with this disclosure.

The metal terminal 30 is made of a material with good electrical conductivity such as copper or its alloy. The metal terminal 30 comprises a horizontal plate 31 and a riser 32 curvedly extending from the horizontal plate 31, and a pin 33 is coupled to both ends of the riser 32 separately, wherein the horizontal plate 31 is embedded into the corresponding horizontal slot 16, and ends of each fixed arm 21 is electrically coupled to both left and right ends of the horizontal plate 31 respectively, and each pin 33 is embedded into each respective embedded slot 14 and hidden in the insulated base 10, and each pin 33 is formed on a side of each clamping arm 23, and both of the riser 32 and the wire arm 13 are stopped and blocked at conductive spring plate 20 and a side of a wire 9 (as shown in FIG. 7).

Further, a plurality of through holes 34 is formed with an interval apart from each other and at the curvedly connected position of the horizontal plate 31 and the riser 32 to facilitate the bending and formation of the riser 32 and the horizontal plate 31 in the manufacturing process. Both sides of the riser 32 have a reinforcing rib 322 to improve the structural strength. In addition, each pin 33 comprises a plurality of engaging teeth 331 facing a side of clamping arm 23 and a latch 332 formed at the top of each engaging tooth 331 and provided for engaging an end of the clamping arm 23. In addition, a chamfer 323 is disposed at a corner position of both sides of the riser 32 to increase the safety distance.

Figure 5:
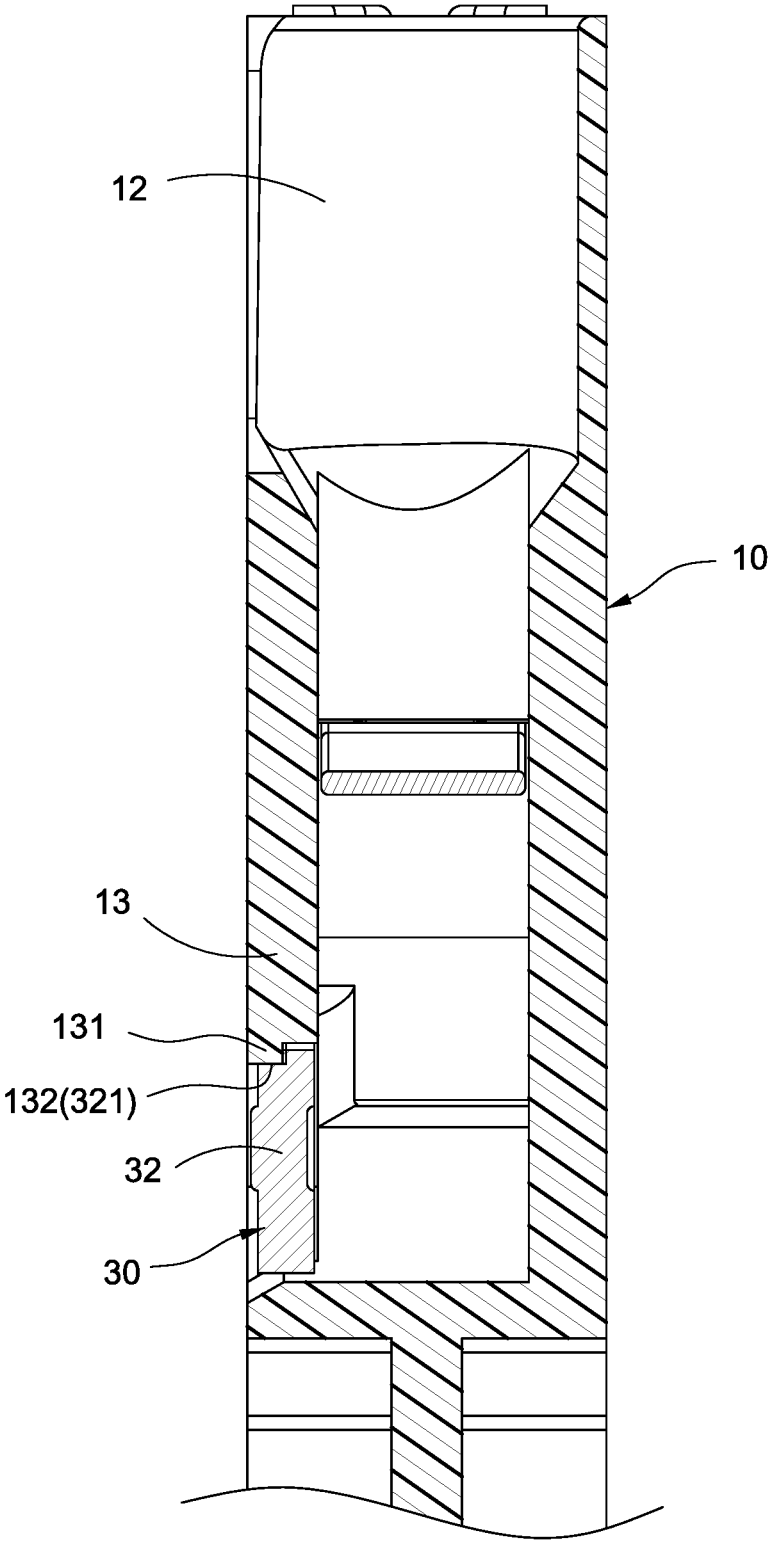
FIG. 5 is a cross-sectional view of Section 5-5 of FIG. 4.

Further, the wire arm 13 and the insulated base 10 are integrally formed, and the wire arm 13 has a free end 131 on a side away from the insulated base 10, a step block 132 on an end surface of the free end 131 (as shown in FIG. 5), and the riser 32 has a step slot 321 formed at a position corresponding to the step block 132 and engaged with the step block 132 to effectively prevent the metal terminal 30 from falling out from the insulated base 10.

Figure 6:
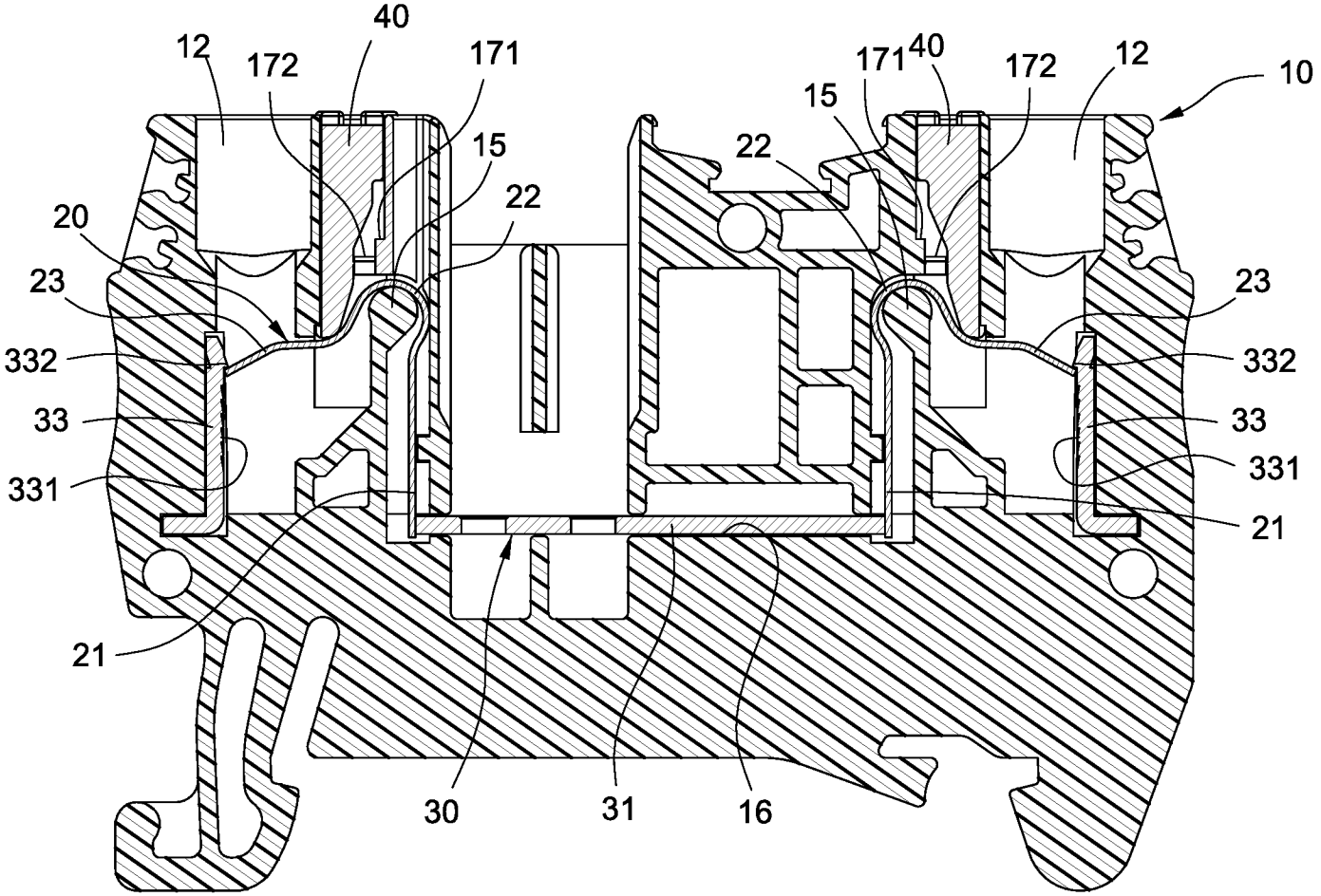
FIG. 6 is a cross-sectional view of a plug terminal block structure of this disclosure.

Further, the plug terminal block structure of this disclosure further comprises a release member 40 plugged into the corresponding release member jack 17 and pressing the clamping arm 23 to produce an elastic deformation, so as to withdraw the wire 9 from the insulated base 10. The release member 40 comprises a block member 41 and a wedge 42 extending downwardly from the block member 41. In addition, a limit portion 171 is disposed inside the release member jack 17 of the insulated base 10 (as shown in FIG. 6) for restricting the downward movement of the block member 41. In addition, a stop plate 172 is installed in the release member jack 17 of the insulated base 10, and a stop portion 421 is disposed on an inner side of the middle section of the wedge 42 and engaged with and blocked by the stop plate 172 to prevent the release member 40 from separating from the insulated base 10.

With reference to FIG. 7 for the use of the plug terminal block, a wire 9 is plugged into the wire inlet 12, and a side of the wire 9 is guided to move by the wire arm 13. After the front end of the wire 9 arrives at the position of the clamping arm 23, the clamping arm 23 will produce an elastic deformation correspondingly. When the clamping arm 23 and the pin 33 jointly clamp and fix the wire 9, both of the wire 9 and the conductive spring plate 20 are blocked by the riser 32 and the wire arm 13, so that the wire 9 and the conductive spring plate 20 will not be exposed, and the conductive spring plate 20 is stably limited in the cavity 11 to improve the safety of use.

While this disclosure has been described by means of specific embodiments, numerous modifications and variations could be made thereto by those skilled in the art without departing from the scope and spirit of this disclosure set forth in the claims.

What is claimed is:

1. A plug terminal block structure, for plugging a wire, comprising:

an insulated base, having a cavity, a wire inlet communicating with the cavity and provided for plugging the wire, a wire arm formed at a side of the wire inlet, an embedded slot formed on the other side of the wire inlet, and a fixed portion formed in the cavity;

a conductive spring plate, installed in the cavity and configured to be corresponsive to the fixed portion, and having a clamping arm formed in the wire inlet; and a metal terminal, comprising a riser, a pin coupled to an end of the riser and embedded into the embedded slot and formed on a side of the clamping arm, and both of the riser and the wire arm being blocked by the conductive spring plate and a side of the wire.

2. The plug terminal block structure as claimed in claim 1, wherein the cavity has a window, and the wire arm and the insulated base are integrally formed on a side of the window.

3. The plug terminal block structure as claimed in claim 1, wherein the wire arm has a free end formed on a side of the insulated base, and a step block is disposed on a surface of the free end, and the riser has a step slot configured to be corresponsive to the step block and coupled to the step block.

4. The plug terminal block structure as claimed in claim 1, wherein the fixed portion comprises a spring plate bracket and a spring plate slot formed between the outer periphery of the spring plate bracket and the insulated base, and the conductive spring plate further comprises a fixed arm and an arcuate section extending from the fixed arm, and the clamping arm extends from an end of the arcuate section away from the fixed arm, and the arcuate section is embedded into the spring plate slot and clamped between the spring plate bracket and the insulated base.

5. The plug terminal block structure as claimed in claim 4, wherein the insulated base has a horizontal slot communicating with the cavity, and the metal terminal further comprises a horizontal plate extending curvedly from the riser and embedded into the horizontal slot, and the fixed arm has an end electrically coupled to an end of the horizontal plate.

6. The plug terminal block structure as claimed in claim 5, further comprising a plurality of through holes formed at the curvedly connected positions of the horizontal plate and the riser, and the riser having a reinforcing rib and a chamfer disposed at a corner end of the riser.

7. The plug terminal block structure as claimed in claim 1, wherein the embedded slot separates the wire arm and the insulated base from each other.

8. The plug terminal block structure as claimed in claim 1, further comprising a plurality of engaging teeth of the pin facing a side of the clamping arm and a latch formed at the top of each engaging teeth and provided for engaging an end of the clamping arm.

9. The plug terminal block structure as claimed in claim 1, further comprising a release member, a release member jack disposed at the insulated base on a side of the wire inlet and communicating with the cavity, the release member being plugged and coupled to the release member jack for pushing the clamping arm to produce an elastic deformation.

10. The plug terminal block structure as claimed in claim 9, wherein the release member comprises a block member and a wedge extending from the block member, a limit portion disposed in the release member jack for restricting the downward movement of the block member.

11. The plug terminal block structure as claimed in claim 10, wherein the release member jack has a stop plate installed therein, and the wedge has a stop portion disposed at a middle section thereof and engaged with and blocked by the stop plate.

* * * * *